US008294120B1

(12) United States Patent
Pamfiloff

(10) Patent No.: US 8,294,120 B1
(45) Date of Patent: Oct. 23, 2012

(54) PROCESS FOR THE EXTRACTION OF ELECTRONS FROM ATOMS AND MOLECULES, THE PRODUCTION OF POSITIVE AND NEGATIVE IONS AND THE COMPOSITION AND DECOMPOSITION OF MOLECULES

(76) Inventor: Eugene B. Pamfiloff, San Anselmo, CA (US)

( * ) Notice: Subject to any disclaimer, the term of this patent is extended or adjusted under 35 U.S.C. 154(b) by 0 days.

(21) Appl. No.: 12/804,673

(22) Filed: Jul. 26, 2010

Related U.S. Application Data

(60) Provisional application No. 61/271,914, filed on Jul. 27, 2009.

(51) Int. Cl.
*G21K 5/00* (2006.01)

(52) U.S. Cl. ..... 250/424; 250/423 R; 250/423 P; 250/423 F; 250/288; 315/111.01; 315/111.81; 315/111.91

(58) Field of Classification Search ..... 250/288, 250/423 R, 424, 425, 426, 427, 423 P, 423 F; 315/111.01, 111.81, 111.91
See application file for complete search history.

(56) References Cited

U.S. PATENT DOCUMENTS 4,486,665 A * 12/1984 Leung et al. ..... 250/427
2006/0284075 A1* 12/2006 Bonne et al. ..... 250/288
2007/0278417 A1* 12/2007 Horsky et al. ..... 250/427
2008/0054171 A1* 3/2008 Bonn et al. ..... 250/282
2008/0269245 A1* 10/2008 Schreiber et al. ..... 514/254.1

* cited by examiner

*Primary Examiner* — David A Vanore
*Assistant Examiner* — Nicole Ippolito

(57) ABSTRACT

The process of the present application differs substantially from the prior art, as it facilitates the deliberate extraction of electrons from atoms and molecules during the production of positive ions, as compared with occasionally and accidentally knocking them away. It is an energy efficient process for the extraction and capture of electrons, production of positive ions and negative ions, the construction of molecules and the selective decomposition of molecules. These results are accomplished by the forcible extraction of electrons from the object molecules and atoms. The present process is superior to any other intended for the production of positive ions and the composition and the decomposition of molecules, because it not only simplifies the process, but it also speeds the process, allowing a continuous stream or beam of particles to be so converted to positive ions. Additionally, the present process demonstrates its superiority to any other because it is extremely efficient, in that, once the system is fully charged, it requires only a small maintenance energy to sustain operation. Furthermore, by the reversal of electric polarity, the process allows the production of a continuous stream or beam of negative ions.

1 Claim, 13 Drawing Sheets

PROCESS FOR THE EXTRACTION OF ELECTRONS FROM ATOMS AND MOLECULES, THE PRODUCTION OF POSITIVE AND NEGATIVE IONS AND THE COMPOSITION AND DECOMPOSITION OF MOLECULES

CROSS-REFERENCE TO RELATED APPLICATION

This application claims the benefit of provisional patent application Ser. No. 61/271,914 filed 2009 Jul. 27 by the present inventor:

FEDERALLY SPONSORED RESEARCH

Not Applicable

SEQUENCE LISTING

Not Applicable

BACKGROUND

This application relates to the field of atomic physics, particularly to the manipulation and control of electrons for the atomic engineering and composition of molecules and the selective decomposition of molecules through an efficient and effective process for the extraction of electrons from atoms and molecules and the insertion of electrons into atoms and molecules.

BACKGROUND

Prior Art

An inspection of each prior art example reveals the disadvantages as compared with the present application.
The following is a listing of some prior art that presently appear relevant:
U.S. Patents or Applications:

| Number | Kind Code/Class | Filing/Issue Date | Patentee |
|---|---|---|---|
| 5872824 | 376/157 | Feb. 16, 1999 | Fries, et al |
| 20030086813 | A1 | May 8, 2003 | Fleischer, Werner |
| 6850403 B1 | 361/230; 361/225 | Feb. 1, 2005 | Gefter, et al |
| 7147692 | 95/210 | Dec. 12, 2006 | Fornai, et al |
| 7176469 B2 | 118/723 CB | Feb. 13 2007 | Leung, et al |
| 7241360 B2 | 118/723 CB | Jul. 10, 2007 | Shabalin, et al |
| 7425709 | 250/423R | Sep. 16, 2008 | Siegfried, et al |
| 7435971 | 250/423R | Oct. 14, 2008 | Vanderberg, et al |
| 7439529 | 250/493.1 | Oct. 21, 2008 | Tantraporn, et al |

Currently, a small number of methods are available to convert electrically neutral atoms or molecules into ions. Neutral atoms contain equal numbers of electrons to the number of protons in the nucleus, while neutral molecules contain electrons in equal numbers to the sum of protons in the nuclei. To ionize a neutral atom or molecule, it is necessary to either add one or more electrons to form a negative ion or knock out one or more electrons to form a positive ion. Ions, for a variety of purposes, have been deliberately produced now for nearly a century. There are several simple methods to form negative ions, however, positive ions are extremely difficult and costly to produce. This is due in part to the high-energy requirements by the current systems that include the continuous application of extreme temperatures during thermal ionization or extremely high voltages continuously applied during coronal discharge. Additional restrictions are imposed by the extremes in the ionization potential or energy requirements to remove the valance or outer and subsequent electrons of various atoms and molecules. The ionization potential is measured in electron volts or kilojoules per mole.

Exposing the target atoms or molecules to either electrical discharge from a cathode such as a disk or pointed emitter, or coronal discharge of electrons in a high voltage system usually produces negatively charged ions. Similarly, a variety of electrostatic precipitators are available for such purposes as negative ions.

These systems also carry a number of disadvantages that include the consumption of high energy continuously over the course of operation. Another is the occasional production of unwanted ions, those that carry a charge opposite from what a system requires. On occasion, an emitted electron will act as a projectile and knockoff or repel an electron from a passing target particle to form the unwelcome positive ion. Through each of the electrostatic methods electrons are emitted to where the successful production of negative ions depends upon the intermittent capture and retention of an electron by a passing atom or molecule. Because the atom or molecule passing the emitter is electrically neutral, it does not attract nor necessarily retain the emitted electron. It is clearly a hit-or-miss situation, resulting with a high percentage of target particles remaining unmodified, and simultaneously being encumbered by the presence of accidental positive ions.

However, if one objective of an implementation is the interminable production of positive ions, then none of the current methods are suitable. If another objective is to break apart or reliably regulate the decomposition of stable or unstable molecules, again, the systems currently available are not suitable. On the other hand, if the purpose is to construct a molecule, even one that is unusual, again, none of the current systems are appropriate.

When applied to molecules, the addition of a single electron will have no effect towards the decomposition of a molecule. Similarly, the removal of a single electron is not sufficient to break the molecular bonds of highly stable molecules such as the carbon dioxide molecule. Systems depending upon the random bombardment of passing atoms or molecules by projectile electrons intended for negative ions are not dependable for the efficient production of positive ions. Furthermore, the prior art primarily intended for negative ions are often modified for intermittent positive ion production. Here, due to the unreliability of the both systems, the presence of negative ions is entirely undesirable or even counterproductive to systems or applications that require only positive ions. Likewise, systems requiring only negative ions are adversely affected by the occasional production of positive ions. The process of the present application, however, overcomes these obstacles.

ADVANTAGES AND SUMMARY

However, as indicated in the description of the process of the present application, by the delicate manipulation and control of atomic electrons, a continuous supply of positive ions or negative ions, whichever are required by the utilization can be produced. Furthermore, the level of control provided by the process allows the construction of molecules, even those that are uncommon or unusual. In addition, the process allows the selective decomposition of existing molecules, where selected individual atoms or selected smaller molecules can be removed from the grouping. The process also allows the complete decomposition of molecules into their constituent isotopes. The obvious advantages of the present application have far-reaching beneficial consequences for many fields and utilizations, including improvements to systems and devices currently in use.

DESCRIPTION OF THE PROCESS

The process of the present application differs substantially from the prior art, as one aspect of it facilitates the deliberate extraction of electrons from atoms and molecules to form positive ions. It is an energy efficient process for the extraction and capture of electrons, production of positive ions and the selective decomposition of molecules or the composition and construction of molecules. These results are accomplished by the forcible extraction of electrons from the object molecules and atoms. The process is superior to any other intended for the production of positive ions because it not only simplifies every implementation or utilization, but it also speeds the operation, allowing a continuous stream or beam of particles to be so converted. The ionized particles of the stream can then be confined in a coherent beam or confined to a magnetic bottle or by other confinement methods. Additionally, the process of the present application demonstrates its superiority to any other because it is extremely efficient, in that, once the system is fully charged, it requires only a small maintenance energy to sustain operation. This is an important feature for any utilization. The advantages are apparent when compared with the unreliability of the current systems where electrons are sporadically knocked away to form the positive ions revealing their hit-or-miss operation.

One embodiment consists of a conductive substance on to which a positive electric charge is placed. The substance exposes a charged surface to the subject atoms or molecules. The charged substance may be constructed of various materials and in various geometrical configurations, sizes, shapes, arrangements, and quantities. The charged substance may also take the form of panes or grids as additional embodiments. Throughout this application the term "plate" will be used to represent a number of embodiments that include but are not limited to the use of non-perforated panels, sheets, disks, bars, rods, shafts, tubes, cones, panes or plates, or similar components. And the term "pane" will be used to represent a number of additional embodiments that include but are not limited to the use of sectioned or perforated panels, sheets, disks, bars, rods, shafts, tubes, cones, plates, panes or similar components, or any combination thereof. And the term "grid" will be used to represent a number of additional embodiments that include but are not limited to the use of screens, lattices, nets, webs, gridirons, gratings, trellises, grills, grids or similar components, or any combination thereof. Collectively, the panes, grids or any combination thereof will be referred to as grids. However, a single grid or complex grid assembly will also be referred to as either the electron extraction unit or the electron insertion unit subject to the embodiment and, or the specific utilization. The charged grids are positioned to maximize contact with the object atoms and molecules, which in some embodiments are guided through the perforations or apertures. Both the panes and grids may take many forms, manufactured from different materials. It could include that of perforated metal plates, perforated metal sheets, wire mesh screens, or similar components through which atoms and molecules will be directed, again situated to maximize contact with the object atoms and molecules. The actual materials, geometrical configurations, sizes, shapes, arrangements, and quantities of all components of a system are determined by the specific utilization. Multiple grids are operated individually, as a group, or as several groups, by which or through which the subject atoms and molecules are directed.

A positive electric charge is placed on the grid material, where less than a +1 electric charge per atom can be applied. For example, 60 percent of the atoms are encouraged to give up one electron, whereby the charges will distribute evenly throughout the grid material. However, a +1 or greater net charge per atom can also be placed on the material, indicating the removal of one or more valence electrons from each atom. The positively charged atoms will forcibly extract electrons from any atom or molecule that closely approaches or comes into contact with the pane or grid material of the electron extraction unit. Other embodiments may utilize one grid to extract the first electron from the subject, a second grid for the second electron and a third grid for the third electron, and so on. Each successive grid may have different opening or perforation sizes and shapes to facilitate the diminishing molecule as it passes from one to the other. Additional control is gained by placing differing levels of charge from one grid to the other. In another embodiment, the subject atoms or molecules could be re-circulated through a single grid held at either a constant net charge or a varying net charge to facilitate the extraction of additional electrons.

Summarizing the previous conditions, and further, because the number of valance electrons varies with different materials, the net average charge per atom of the grid can be controlled. Additional control is obtained by adjustment of the thickness of pane or grid material, type of pane or grid material and the shape and opening dimensions of mesh or perforations in relation to the size of the subject atom or molecule. Additional control is gained through adjustable aperture sizes in height, width and depth and with shapes adjusted to maximize results for specific subject atoms or molecules. Further controls are obtained by controlling the angle of the grid face and the aperture openings, holes or perforations relative to the direction of the gas, vapor, liquid, plasma or particle flow. One, two, or multi-dimensional angular control of the panes or grids can be applied to substantially increase the probability of direct contact. Direct contact between the grid material substantially increases the probability of extracting an electron from the subject particle. Moreover, by the strict control of the variables described herein, including the average net positive charge per atom on the electron extraction unit, selective decomposition of molecules is accomplished. This has far reaching consequences, as subsequently described.

The net charge required by an embodiment or utilization is applied to the grids by a strong negative electric field produced by the electric potential difference between the plates of a parallel plate capacitor powered by a voltage source. In another embodiment, a strong magnetic field will have a similar effect with respect to placing a net charge on the panes or grids. Likewise, in another embodiment a combination of electric and magnetic fields can be applied for this purpose. In some embodiments the grid assembly takes the place of one of the field plates of the capacitor. However, once the capacitor field plates are fully charged and the valance electrons are expelled from the grid material, the system requires only a small energy supply to maintain the effectiveness of the process. The negative electric field repels the valence electrons of the pane or grid atoms towards the positive component that also attracts. This further causes the electrons to move to a location to where their return can be restricted by a valve. Here, they are held for additional manipulation, stored for later utilization or expelled to ground. A close encounter or direct contact between the positively charged surfaces and the subject atoms or molecules results in the forcible extraction of their electrons, thus producing positive ions. By controlling the quantity of positive charges on the charged pane or grid material, the size and shape of the openings, holes, perforations, or mesh, and the thickness of the material, atoms may be selectively removed from molecules or molecules may be selectively decomposed. As can be seen, the present process is not only innovative in the production of atomic and molecular ions, but also superior to any prior art.

The process also functions in a vacuum, allowing the ionization of specific atoms and molecules for the acceleration of positive ions for various purposes including propulsion. Other embodiments can accelerate negative ions and thereby produce a stream or beam of negative particles. The process is applicable for but not limited to the decomposition of carbon dioxide, carbon monoxide, including methane and other hydrocarbon molecules into positive ions of the original constituent isotopes. The process is also applicable to the production of positive ions of individual atoms, or streams or beams of different atoms and molecules for various additional implementations, including medical, scientific, commercial and industrial, and as further stated below. The process is useful in chemistry, being applicable to atoms that do not readily form compounds, allowing the formation of unusual molecules. A natural result of the process allows the directional control and acceleration, collection and segregation of the ions and other particles produced. The process has many applications in medicine, where it can be used for the treatment of tumors, certain cancers and other maladies. The process is also applicable to the molecular decomposition of viruses, bacteria, pollen, molds, mildew, fungus, plankton, cells and other organisms. The decomposition of a vital molecule of an organism will usually lead to its destruction. And without limiting its usage, it is expedient for the attraction or repulsion of both positively charged and negatively charged particles, including atomic or molecular ions.

By simply changing the polarity of the electric potential, the process is converted to the production of negative ions of atoms and molecules. Four variations of an embodiment with this modification are shown in FIGS. 1C, 2C, 3C and 4C.

The process facilitates and greatly simplifies the engineering and composition of molecules, including those that are unusual or uncommon, as described herein. Two or more different atoms that are run through the present process and converted into +1, +2 or +3 positive ions, can now be diverted and isolated thus allowing the ions to mix and unite into molecules. The composition of the new molecules is specifically engineered to accommodate a variety of uses.

DRAWINGS

Figures

Described below are representations of several basic embodiments for which the designations are not indicative of any specific order or preference over any other embodiment. In the drawings, closely related figures have the same alphabetic suffix but different numbers.

DRAWINGS

Reference Numerals

| | | | |
|---|---|---|---|
| 20 | Power source | 26cd | Second grid |
| 22 | Negative field plate | 26ce | Third grid |
| 24 | Positive field plate | 26cg | Multipart grid group N |
| 26aa | Positive electron extraction grid | 28 | Valve assembly, represented by a diode |
| 26ab | Second extraction grid | 30a | Positive ion diverter |
| 26ac | Third extraction grid | 30b | Negative ion diverter |
| 26ag | Multipart grid group P | 32a | Diverter charge unit P |
| 26bb | Positive electron extraction grid | 32b | Diverter charge unit N |
| 26bc | Second grid | 34 | Charge collector |
| 26bd | third grid | 36 | Valve assembly, represented by a diode |
| 26bg | Multipart grid group PFP | 38 | Charge distribution control unit |
| 26cc | Negative electron insertion grid | 40 | Field plate monitor and control unit |

DETAILED DESCRIPTION

FIGS. 1A, 2A, 3A, 4A, 5A and 6A—Variations of One Embodiment

Figure 1A:
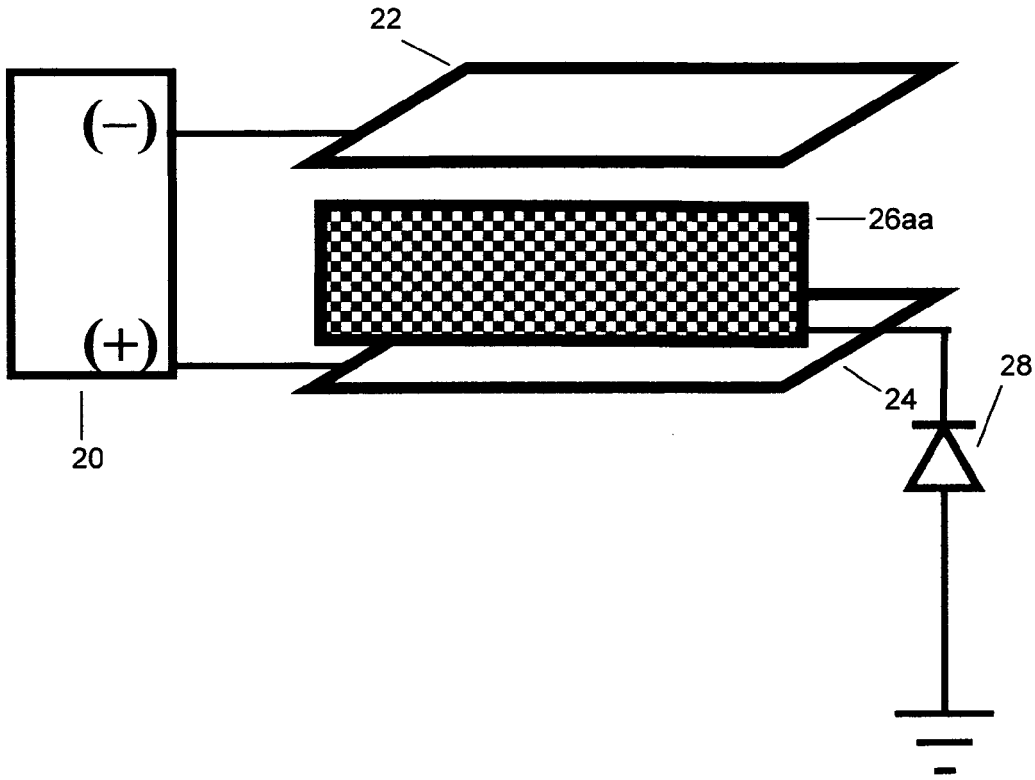
FIG. 1A shows one variation of an embodiment that forcibly extracts electrons to produce positive ions, where the extracted electrons are distributed to ground.

FIG. 1A shows one variation of the basic components of one embodiment coupled with a schematic diagram indicating their relative position within an electronic circuit. The components include a power source, part 20 with the negative terminal connected to the negative field plate, part 22. The other terminal of the power source is connected to the positive field plate, part 24. Situated between the two field plates is the grid representing the electron extraction unit (EEU), part 26*aa*, which is connected to a valve, part 28 that allows electrons to move in one direction only, here, as shown, to ground. A high voltage potential difference is placed upon the conductive field plates. Here the positive field plate experiences a loss of electrons and produces a strong positive electric field, while simultaneously electrons accumulate upon the negative field plate thus producing a strong negative electric field. Consequently, the grid, situated between the field plates, experiences the strong negative electric field, which repels valance electrons from the atoms of the grid towards the positive element. Once the field plates are charged, energy consumption reduces substantially to only a diminutive maintenance level that will be applied thereafter infrequently. The quantity of repelled valance electrons is regulated by the strength of the electric field placed upon the field plates. To prevent electrons jumping to or from the grid, the grid is isolated from the plates with either a sufficient gap or with a minimal nonconductive barrier or both and placed as close as possible to each field plate. The expelled valance electrons of the grid atoms repel each other and are expelled to ground leaving a strong positive charge on the grid. The valance electrons are prevented from returning by the valve, here represented by a diode. The choice of the grid material influences the maximum average net charge per atom, which in turn regulates the net charge that can be placed upon the atom or molecule targeted for ionization. Now, depending upon the implementation, as the targeted particles are guided along or through the grid apertures, every close encounter or direct contact with the positively charged grid results in the forcible extraction of their valance electrons, the number being influenced by the net charge per atom of the grid. Each atom of the grid that has given up one or more electrons will snatch electrons at every opportunity from every particle passing in close proximity. The target atom or molecule thus becomes a +1 or greater positive ion, which can now be controlled and manipulated for various purposes. Meanwhile, the electrons that were forcibly extracted from the target particles are expelled to ground or as shown in subsequent figures, put to work elsewhere.

In each of the following FIGS. 2A through 6A, the sequence of operation described above is similar, although supplementary control over the newly formed positive ions or the extracted electrons or both are added.

Figure 2C:
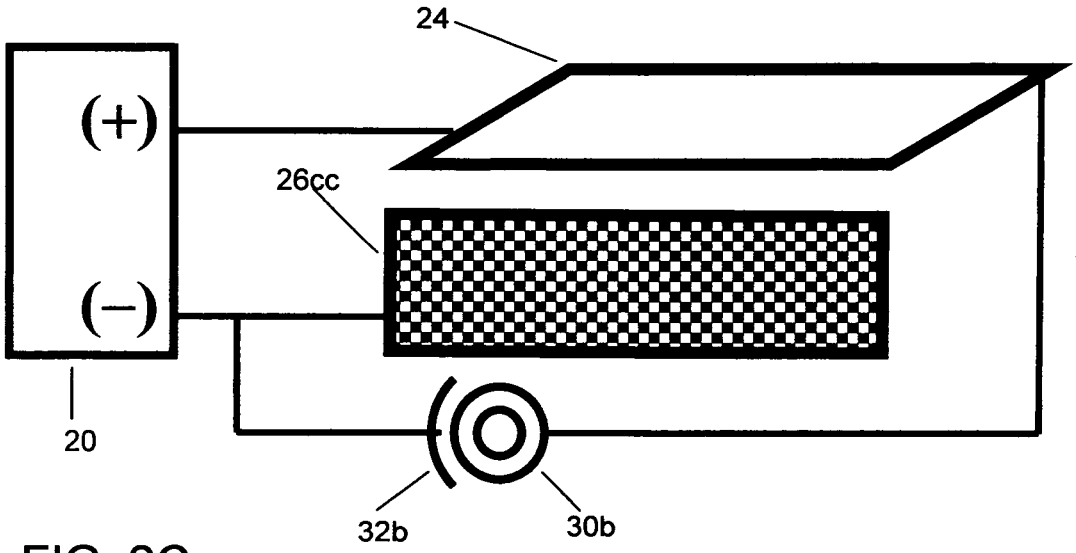
FIG. 2C shows another variation of the embodiment that produces negative ions with an attached ion diverter.
Figure 2A:
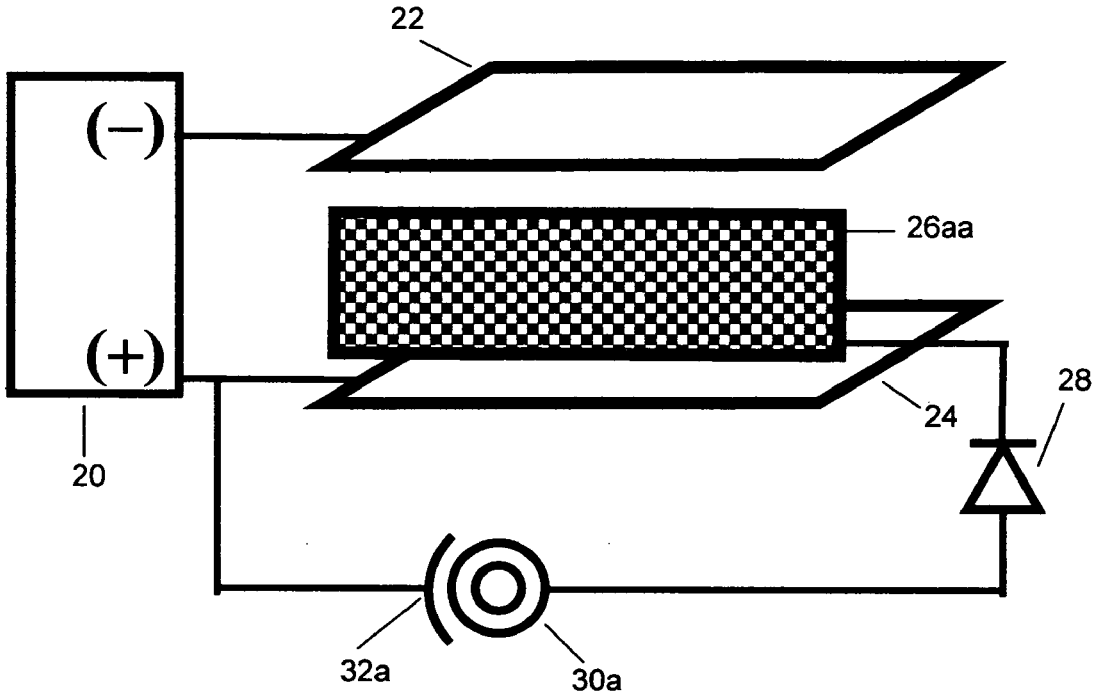
FIG. 2A shows another variation of the embodiment that produces positive ions with an attached ion diverter.

FIG. 2A shows another variation of the basic components of the previous embodiment coupled with a schematic diagram indicating their relative position within an electronic circuit. The components include a "power source, part 20, which is connected to the negative field plate, part 22. Through the other terminal, the power source is connected to the positive field plate, part 24. Situated between the two field plates is the "electron extraction unit, part 26*aa*", which is connected to a valve, part 28 allowing electrons to move in one direction only, here, as shown, to the ion diverter, part 30*a*. Through a bias voltage the ion diverter directs the positive ions to a specific location for further manipulation or at higher voltages it accelerates the ions for various purposes. The diverter also assists in the removal from the grid of extracted electrons assisted by the positive charge placed on the diverter charge unit, part 32*a*. And through various means, the subject atoms or molecules are directed and guided through the electron extraction unit. Additionally, the process functions as described above in FIG. 1A.

Figure 3A:
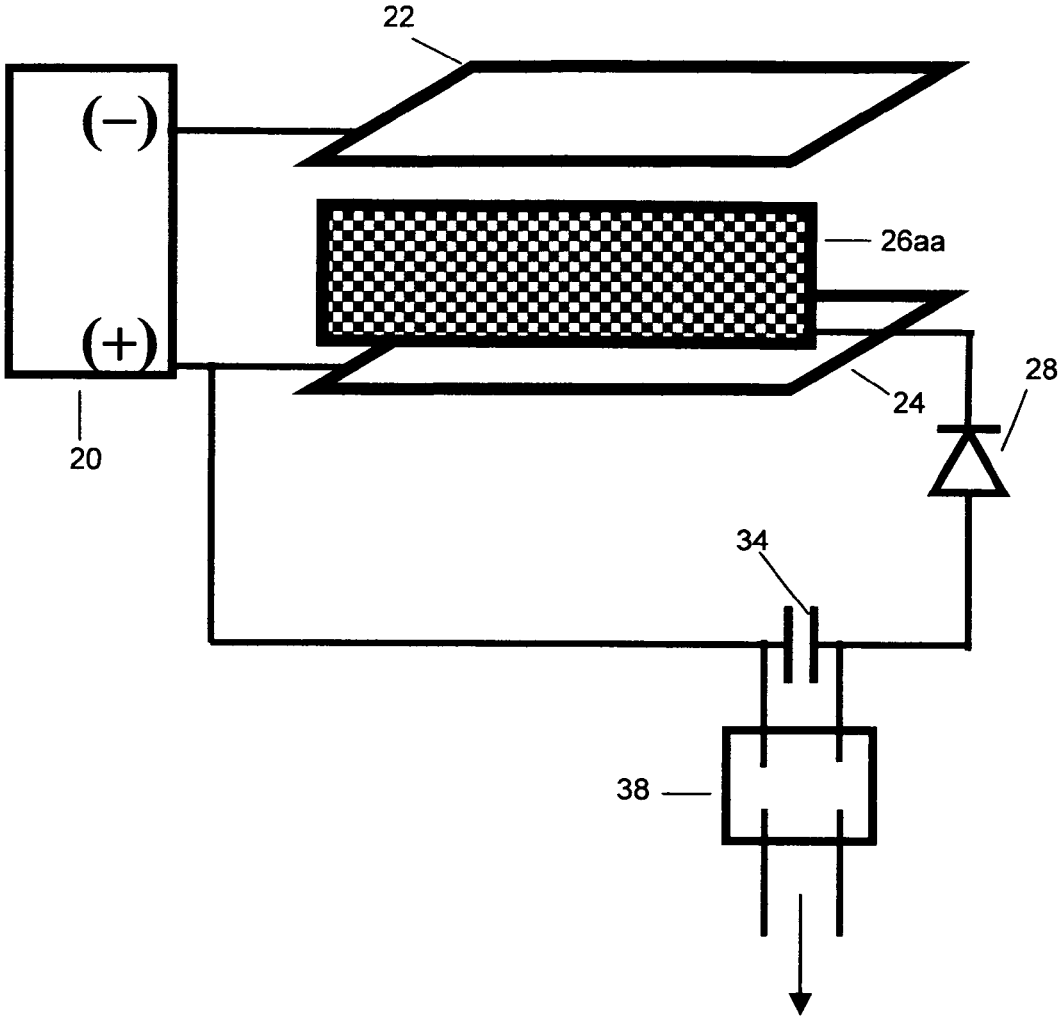
FIG. 3A shows another variation of the embodiment that produces positive ions where the extracted electrons are distributed to a collector.

FIG. 3A shows another variation of the basic components of the previous embodiment coupled with a schematic diagram indicating their relative position within an electronic circuit. The components include a power source, part 20, which is connected to the negative field plate, part 22. Through the other terminal, the power source is connected to the positive field plate, part 24. Situated between the two field plates is the electron extraction grid, part 26*aa*, which is connected to a valve, part 28 allowing electrons to move in one direction only, here, as shown, to the charge collector, part 34. One or more collector units attract and retain the extracted electrons providing a location for them to accumulate. The collector is connected to a charge distribution control unit, part 38, which moves the charge to various storage devices. And through various means, the subject particles are directed and guided through the electron extraction unit. Additionally, the process functions as described above in FIG. 1A.

Figure 4C:
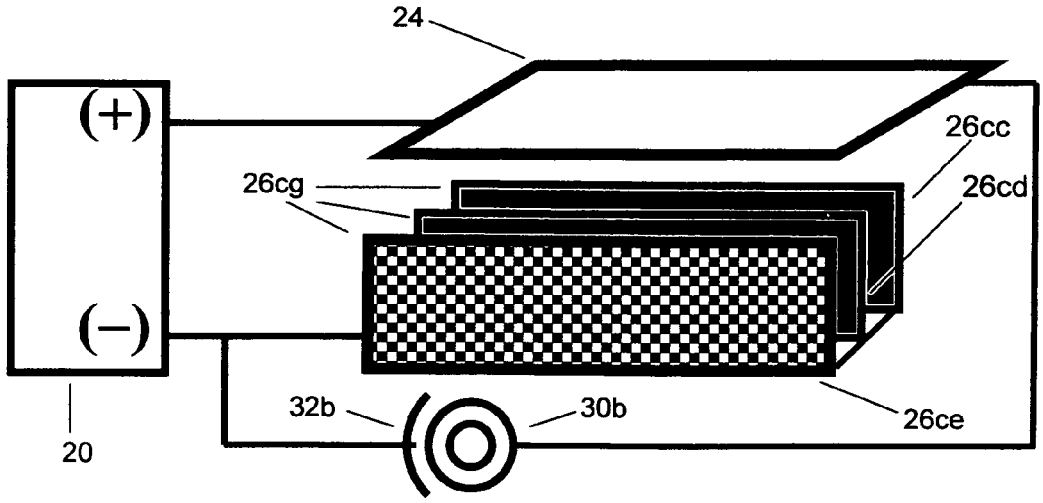
FIG. 4C shows another variation of the embodiment that produces negative ions with an attached ion diverter, coupled with a complex multipart grid group electron insertion unit.
Figure 4A:
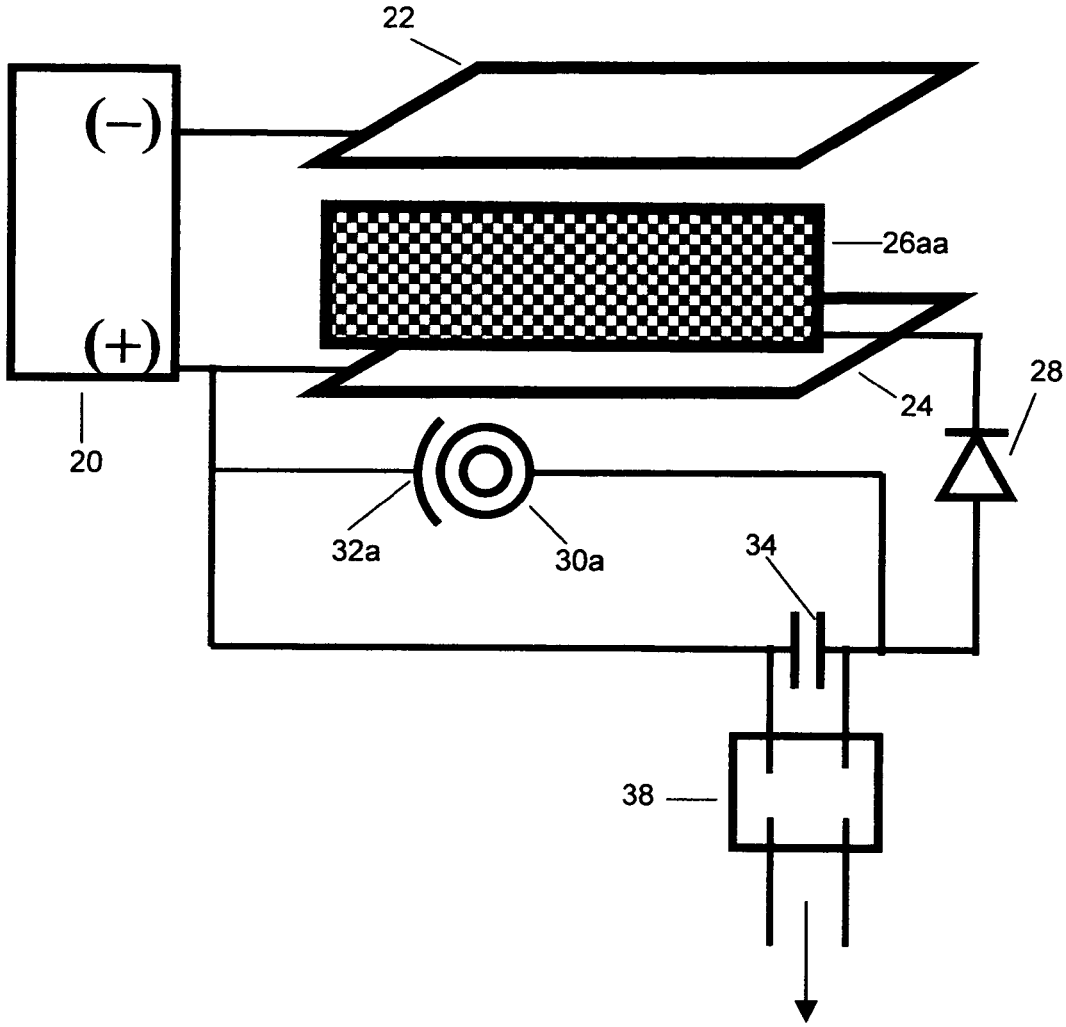
FIG. 4A shows another variation of the embodiment that produces positive ions showing both the ion diverter and the electron collector.

FIG. 4A shows another variation of the basic components of the previous embodiment coupled with a schematic diagram indicating their relative position within an electronic circuit. The components include a power source, part 20, which is connected to the negative field plate, part 22. Through the other terminal, the power source is connected to the positive field plate, part 24. Situated between the two field plates is the electron extraction unit, part 26*aa*, which is connected to a valve, part 28 allowing electrons to move in one direction only, here, as shown, to the ion diverter, part 30*a* and simultaneously to the charge collector, part 34. Through a bias voltage the ion diverter directs the positive ions to a specific location for further manipulation or at higher voltages it accelerates the ions for various purposes. The diverter also assists in the removal from the grid of extracted electrons assisted by the positive charge placed on the diverter charge unit, part 32*a*. One or more collector units attract and retain the extracted electrons providing a location for them to accumulate. The collector is connected to a charge distribution control unit, part 38, which moves the charge to various storage devices. And through various means, the subject particles are directed and guided through the electron extraction unit. Additionally, the process functions as described above in FIG. 1A.

Figure 5A:
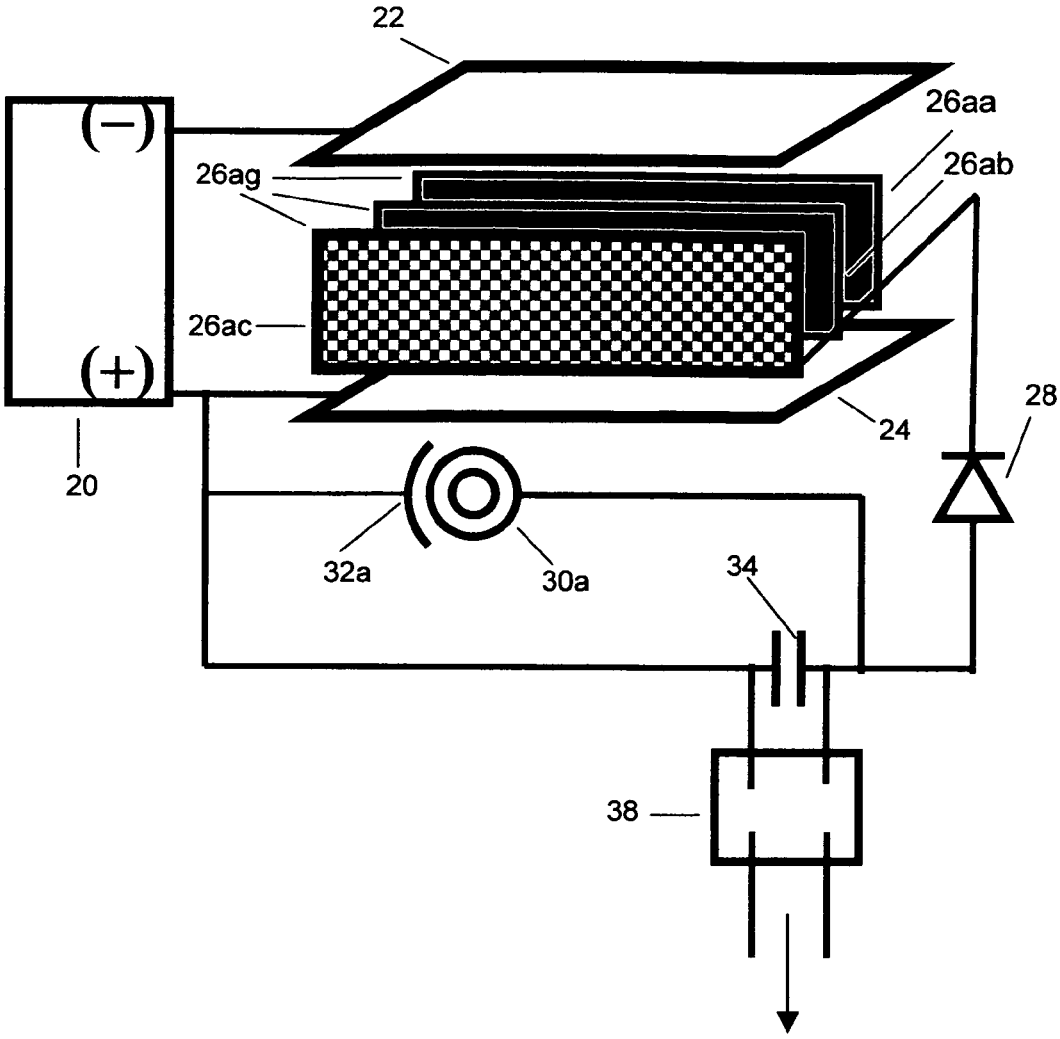
FIG. 5A shows another variation of the embodiment that produces positive ions showing both the ion diverter and the electron collector, with a complex multipart grid group extraction unit.

FIG. 5A shows another variation of the basic components of the previous embodiment coupled with a schematic diagram indicating their relative position within an electronic circuit. The components include a power source, part 20, which is connected to the negative field plate, part 22. Through the other terminal, the power source is connected to the positive field plate, part 24. Situated between the two field plates is the Multipart grid group, part 26*ag*, which is connected to a "valve, part 28 allowing electrons to move in one direction only, here, as shown, to the ion diverter, part 30*a* and simultaneously to the "charge collector, part 34. Through a bias voltage the ion diverter directs the positive ions to a specific location for further manipulation or at higher voltages it accelerates the ions for various purposes. The diverter also assists in the removal from the grid of extracted electrons assisted by the positive charge placed on the diverter charge unit, part 32*a*. Here, the electron extraction unit is shown to consist of three grids, however, the required number is prescribed by the specific utilization. The first grid, identified as being the first relative to the flow direction of the subject particles, is designated to extract the first electron from the target, while the subsequent grids will remove additional electrons from the subject. The grids are also identified individually as follows, part 26*aa* for the first, part 26*ab* for the second, part 26*ac* for the third and so on. One or more collector units attract and retain the extracted electrons providing a location for them to accumulate. The collector is connected to a charge distribution control unit, part 38, which moves the charge to various storage devices. Multipart grid groups can have two or more grid, as many as are necessary for a particular embodiment or utilization. And through various means, the subject particles are directed and guided through the electron extraction unit. Additionally, the process functions as described above in FIG. 1A.

Figure 6A:
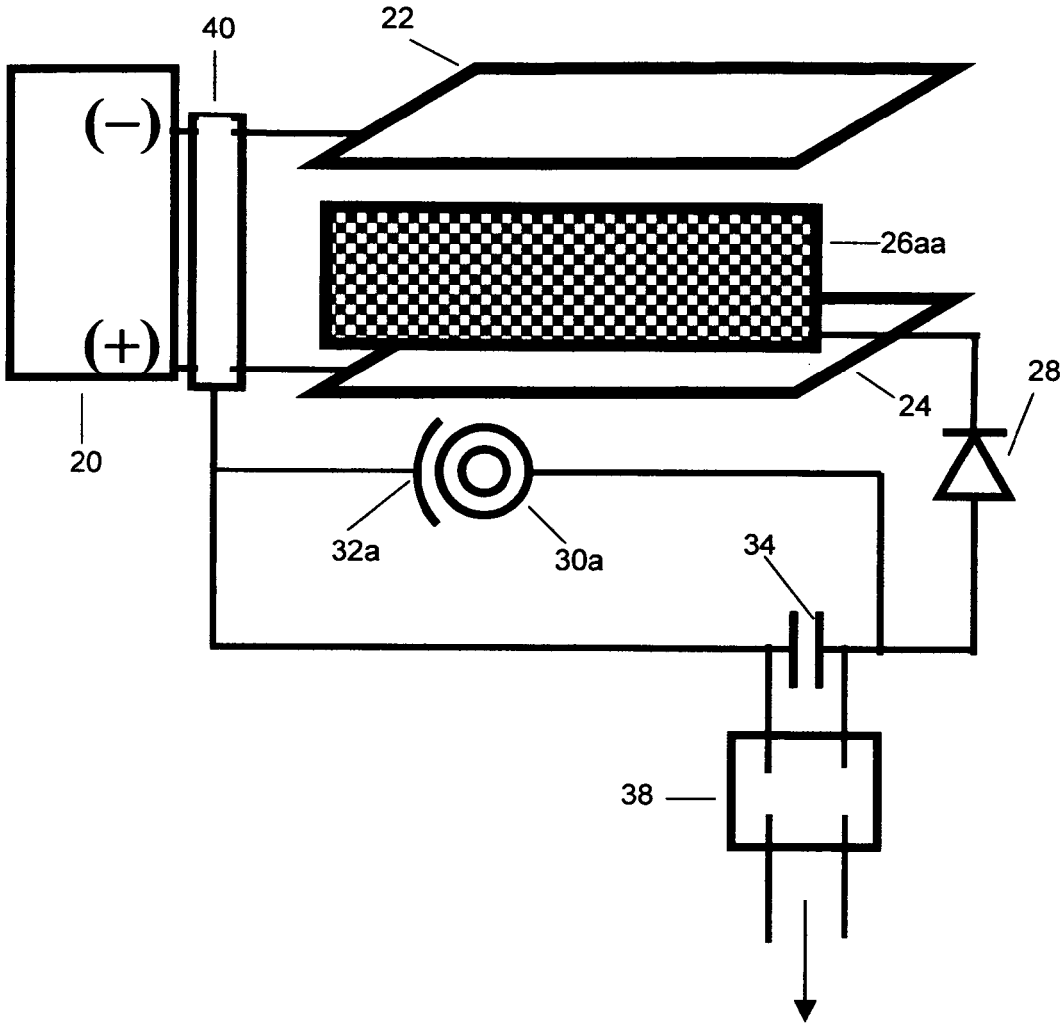
FIG. 6A shows another variation of the embodiment that produces positive ions showing both the ion diverter and the electron collector with two control units.

FIG. 6A shows another variation of the basic components of the previous embodiment coupled with a schematic diagram indicating their relative position within an electronic circuit. The components include a power source, part 20, which is connected to the negative field plate, part 22. Through the other terminal, the power source is connected to the positive field plate, part 24. Situated between the two field plates is the "electron extraction unit, part 26*aa*, which is connected to a "valve, part 28" allowing electrons to move in one direction only, here, as shown, to the ion diverter, part 30*a* and simultaneously to the charge collector, part 34. Through a bias voltage the ion diverter directs the positive ions to a specific location for further manipulation or at higher voltages it accelerates the ions for various purposes. The diverter also assists in the removal from the grid of extracted electrons assisted by the positive charge placed on the diverter charge unit, part 32*a*. One or more collector units attract and retain the extracted electrons providing a location for them to accumulate. The collector is connected to a charge distribution control unit, part 38, which moves the charge to various storage devices. This variation contains the Field plate monitor and control unit, part 40. This unit monitors and controls the charge on the field plates, which in turn controls the net charge per atom of the grid. And through various means, the subject particles are directed and guided through the electron extraction unit. Additionally, the process functions as described above in FIG. 1A.

DETAILED DESCRIPTION

Figure 1B:
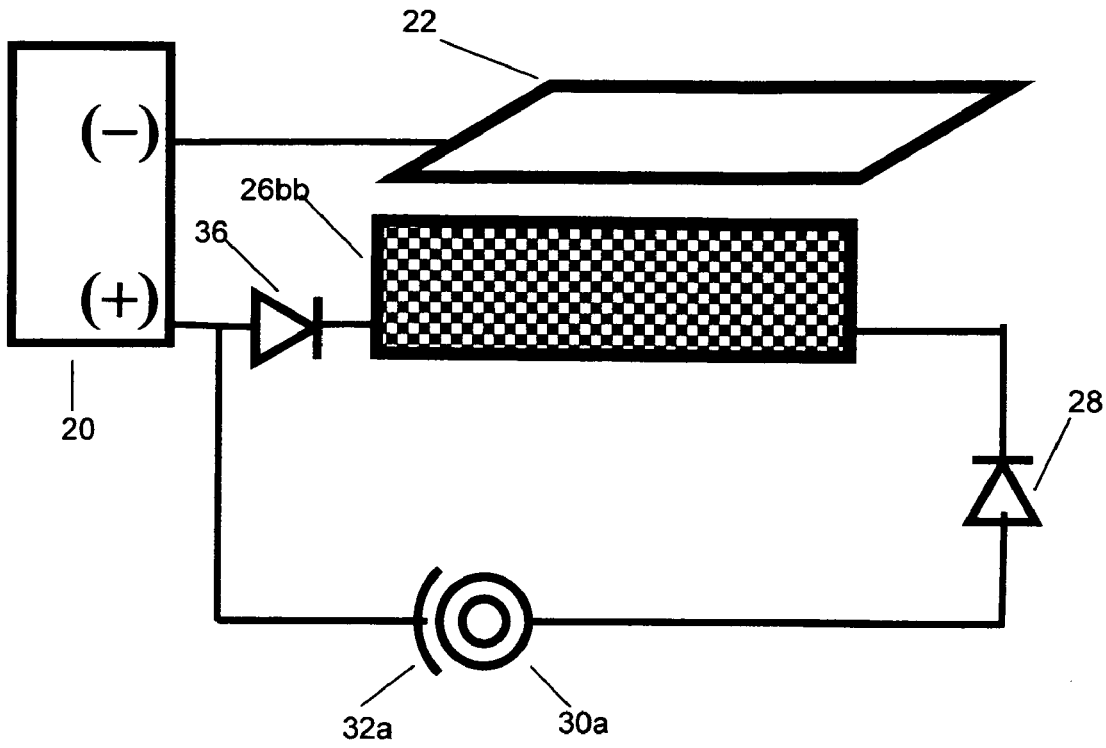
FIG. 1B shows one variation of another embodiment that produces positive ions where the electron extraction unit doubles as the positive field plate with an attached ion diverter.
Figure 2B:
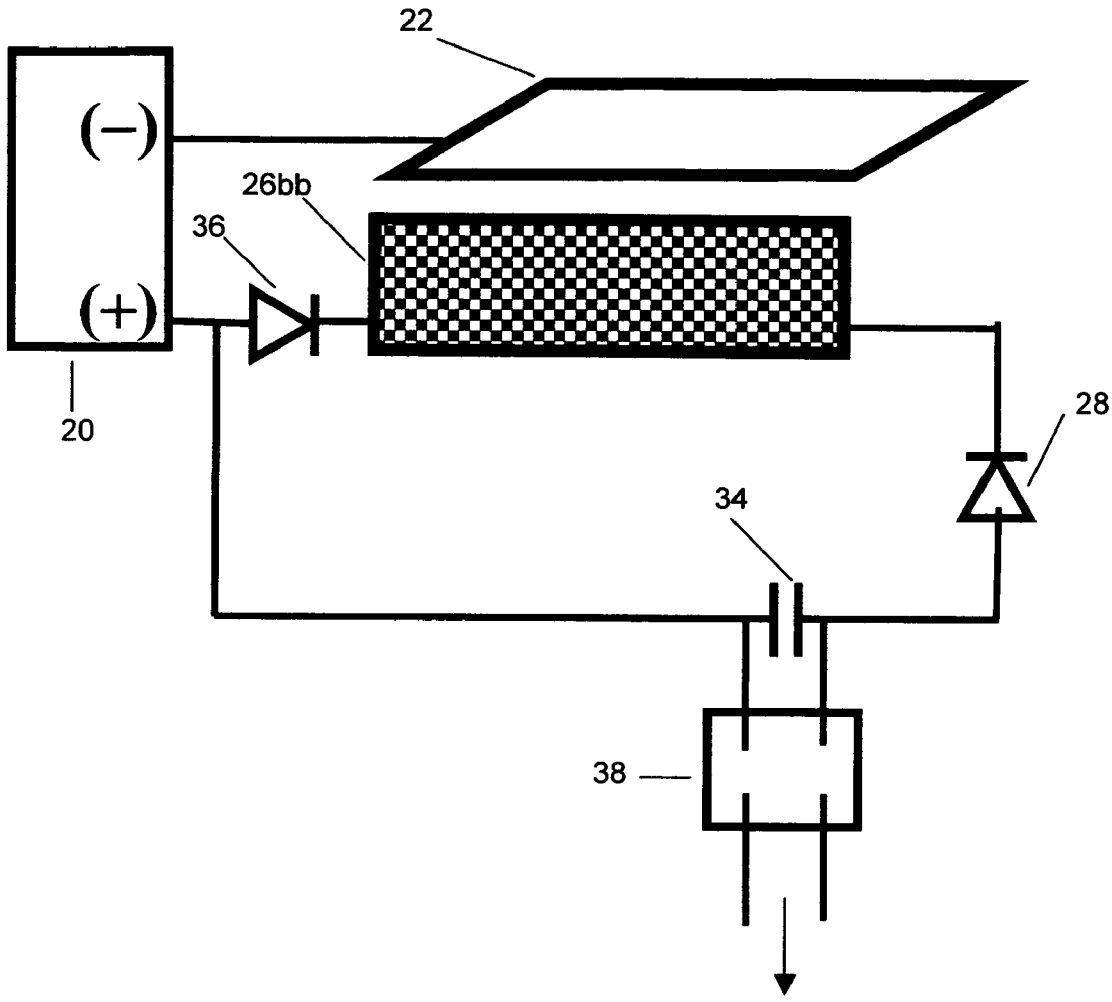
FIG. 2B shows another variation of the embodiment that produces positive ions where the extracted electrons are distributed to a collector with control unit.

FIGS. 1B, 2B, 3B, 4B and 5B—Variations of Another Embodiment FIG. 1B shows one variation of the basic components of another embodiment coupled with a schematic diagram indicating their relative position within an electronic circuit. The components include a power source, part 20 with the negative terminal connected to the negative field plate, part 22. However, in this embodiment the grid is a dual function positive electron extraction grid, part 26*bb*. The unit is connected to two valves, part 28, which connects the ion diverter, part 30*a* while valve part 36 connects to the power source part 20 and the diverter charge unit, "part 32*a*". Both valves are represented by diodes. A high voltage potential difference is placed upon the conductive field plates. Here the dual function grid and field plate experiences a loss of electrons and produces a strong positive electric field due to the loss of valance electrons in the atoms of the grid material. While simultaneously electrons accumulate upon the negative field plate thus producing a strong negative electric field, contributing to the evacuation of valance electrons from the grid. Initially, the valance electrons will move through valve 36 through the power source and to the negative field plate. This continues until the field plate is saturated, where then the remaining valance electrons and the subsequent extracted electrons will move through valve 28 and move to the ion diverter, part 30*a*, until it has saturated. Here, the electrons can be returned to the ions or a charge distribution unit (not shown), part 38, can nevertheless be attached across parts 30*a* and 32*a* to remove and distribute the excess electrons, similarly to what is shown in FIG. 2B. Once the field plates are charged, energy consumption reduces substantially to only a diminutive maintenance level that will be applied thereafter infrequently. The quantity of repelled valance electrons is regulated by the strength of the electric field placed upon the field plates. To prevent electrons jumping to the grid from the negative field plate, the grid is isolated from the plate with either a sufficient gap or with a minimal nonconductive barrier or both and placed as close as possible to the field plate. The expelled valance electrons of the grid atoms repel each other and are attracted to the positive terminal leaving a strong positive charge on the grid. The valance electrons are prevented from returning by the valve, "part 36", here represented by a diode. The choice of the grid material influences the maximum average net charge per atom, which in turn regulates the net charge that can be placed upon the atom or molecule targeted for ionization. Now, depending upon the implementation, as the targeted particles are guided along or through the grid apertures, every close encounter or direct contact with the positively charged grid results in the forcible extraction of their valance electrons, the number being influenced by the net charge per atom of the grid. Each atom of the grid that has given up one or more electrons will seize and forcibly extract electrons at every opportunity from every particle passing in close proximity. The target atom or molecule thus becomes a +1 or greater positive ion, which can now be controlled and manipulated for various purposes.

In each of the following FIGS. 2B through 5B, the sequence of operation described above is similar, although supplementary control over the newly formed positive ions or the extracted electrons or both are added.

FIG. 2B shows another variation of the basic components of the previous embodiment coupled with a schematic diagram indicating their relative position within an electronic circuit. The components include a power source, part 20, which is connected to the negative field plate, part 22. Through the other terminal, the power source is connected to the positive electron extraction grid, part 26*bb*. The unit is connected to two valves, part 28, which connects the charge collector, part 34 while valve part 36 connects to the power source part 20 and the positive terminal of, part 34. Both valves are represented by diodes. One or more collector units attract and retain the extracted electrons providing a location for them to accumulate. The collector is connected to a charge distribution control unit, part 38, which moves the charge to various storage devices. Initially, the valance electrons will move through valve 36 through the power source and to the negative field plate. This continues until the field plate is saturated, where then the remaining valance electrons and the subsequent extracted electrons will move through valve 28 and store at the charge collector, part 34. And through various means, the subject particles are directed and guided through the grid. Additionally, the process functions as described above in FIG. 1B.

Figure 3B:
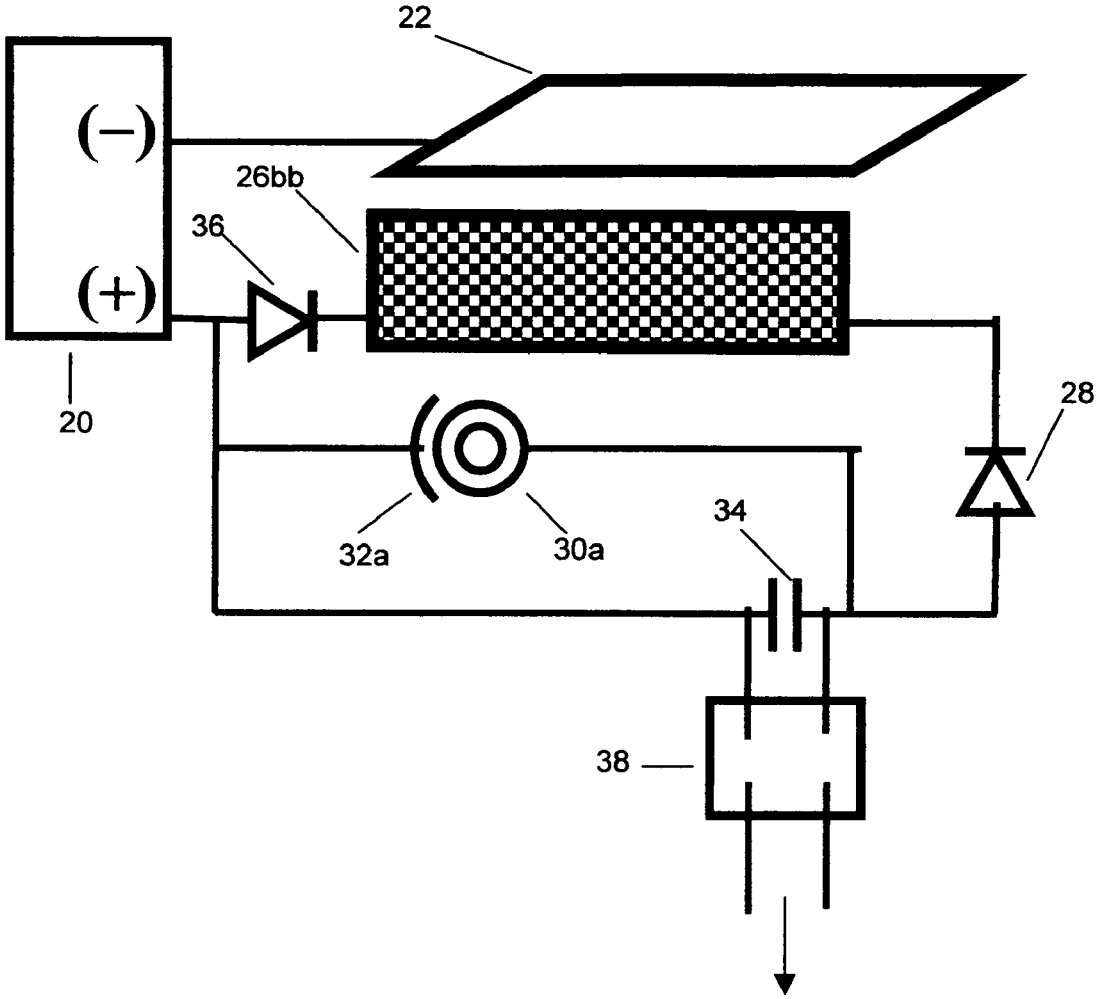
FIG. 3B shows another variation of the embodiment that produces positive ions where the extraction unit doubles as the positive field plate with both a collector with control unit and an attached ion diverter.

FIG. 3B shows another variation of the basic components of the previous embodiment coupled with a schematic diagram indicating their relative position within an electronic circuit. The components include a power source, part 20, which is connected to the negative field plate, part 22. Through the other terminal, the power source is connected to the positive electron extraction grid, part 26*bb*. The unit is connected to two valves, part 28, which connects the charge collector, part 34 and the diverter, part 30*a*, while valve part 36 connects to the power source part 20 and the positive terminal of part 34. Both valves are represented by diodes. Invariably, some electrons will move to the ion diverter, part 30*a*, until it has saturated. One or more collector units attract and retain the extracted electrons providing a location for them to accumulate. The collector is connected to a charge distribution control unit, part 38, which moves the charge to various storage devices. Initially, the valance electrons will move through valve 36 through the power source and to the negative field plate. This continues until the field plate is saturated, where then the remaining valance electrons and the subsequent extracted electrons will move through valve 28 and store at the charge collector, part 34. And through various means, the subject particles are directed and guided through the electron extraction grid. Additionally, the process functions as described above in FIG. 1B.

Figure 4B:
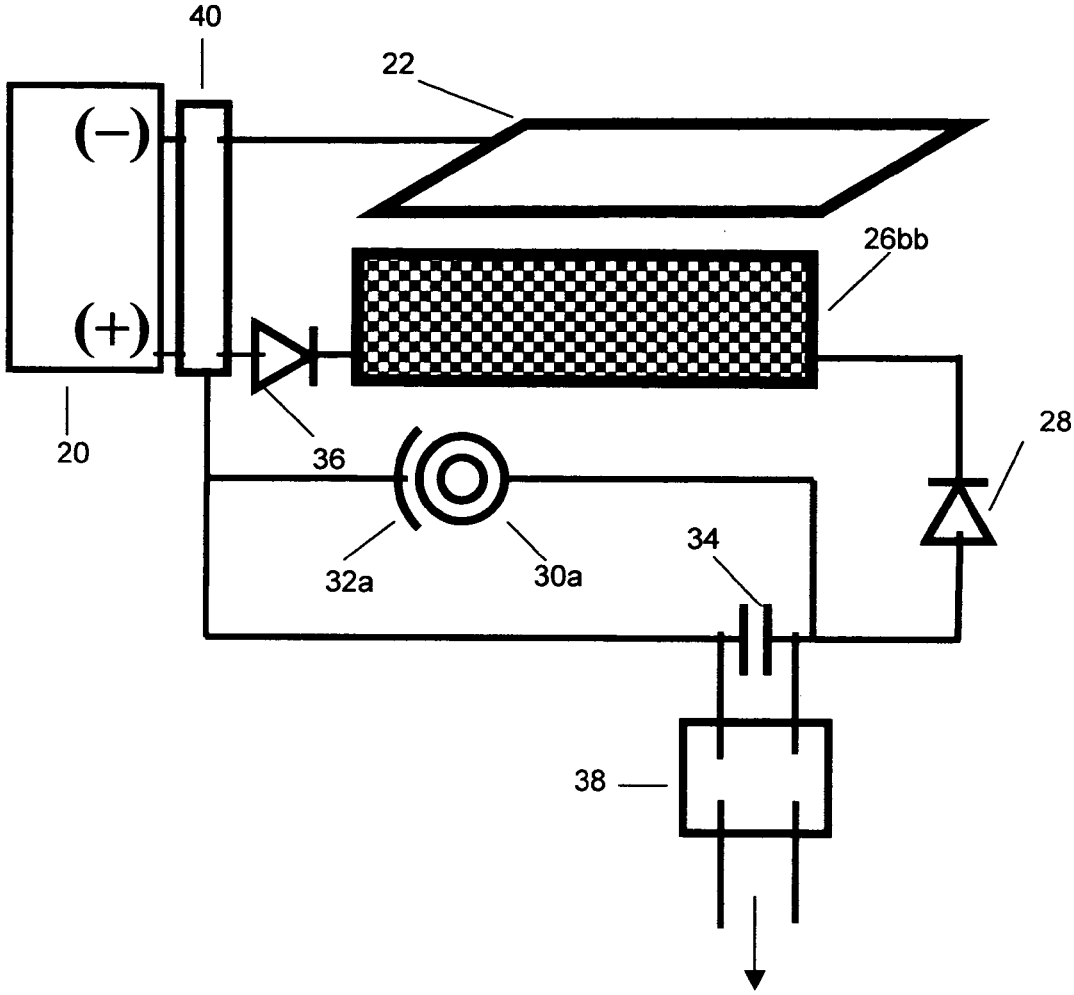
FIG. 4B shows another variation of the embodiment that produces positive ions where the extraction unit doubles as the positive field plate with a collector, an attached ion diverter and control units.

FIG. 4B shows another variation of the basic components of the previous embodiment coupled with a schematic diagram indicating their relative position within an electronic circuit. It is identical to FIG. 3B, except that the field plate monitor and control unit, "part 40" has been added. The components include a power source, part 20, which is connected to the negative field plate, part 22. Through the other terminal, the power source is connected to the positive electron extraction grid, part 26*bb*. The unit is connected to two valves, part 28, which connects the charge collector, part 34 and the diverter, part 30*a*, while valve part 36 connects to the power source part 20 and the positive terminal of part 32*a* and 34. Both valves are represented by diodes. Invariably, some electrons will move to the ion diverter, "part 30*a*", until it has saturated. One or more collector units attract and retain the extracted electrons providing a location for them to accumulate. The collector is connected to a charge distribution control unit, part 38, which moves the charge to various storage devices. Initially, the valance electrons will move through valve 36 through the power source and to the negative field plate. This continues until the field plate is saturated, where then the remaining valance electrons and the subsequent extracted electrons will move through valve 28 and store at the charge collector, part 34. And through various means, the subject particles are directed and guided through the electron extraction grid. Additionally, the process functions as described above in FIG. 1B.

Figure 5B:
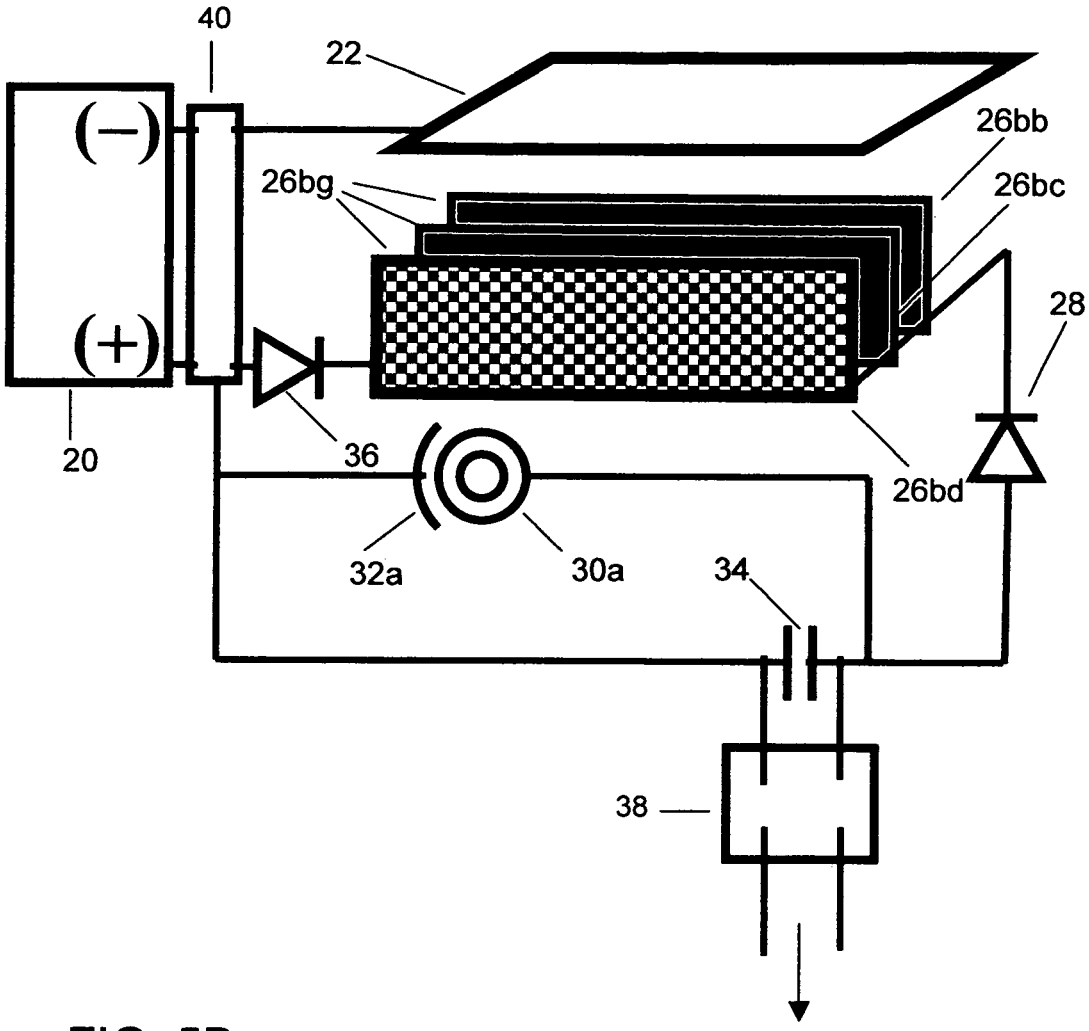
FIG. 5B shows another variation of the embodiment that produces positive ions where the extraction unit doubles as the positive field plate with a collector, an attached ion diverter and control unit, coupled with a complex multipart grid group extraction unit with second control unit.

FIG. 5B shows another variation of the basic components of the previous embodiment coupled with a schematic diagram indicating their relative position within an electronic circuit. It is identical to FIG. 4B, except that the multipart grid group, part 26*bg* has replaced the positive electron extraction grid, part 26*bb*, which can contain more than three grids, subject to the utilization. The components include a "power source, part 20", which is connected to the "negative field plate, part 22". Through the other terminal, the power source is connected to "part 26*bg*". This unit is connected to two valves, "part 28", which connects the charge collector, "part 34" and the diverter, "part 30*a*", while valve "part 36" connects to the power source "part 20" and the positive terminal of 32*a* and part 34. Both valves are represented by diodes. Invariably, some electrons will move to the ion diverter, "part 30*a*", until it has saturated. One or more collector units attract and retain the extracted electrons providing a location for them to accumulate. The collector is connected to a "charge distribution control unit, part 38", which moves the charge to various storage devices. Initially, the valance electrons will move through valve "36" through the power source and to the negative field plate. This continues until the field plate is saturated, where then the remaining valance electrons and the subsequent extracted electrons will move through valve "28" and store at the charge collector, "part 34". Multipart grid groups can have two or more grid, as many as are necessary for a particular embodiment or utilization. And through various means, the subject particles are directed and guided through the electron extraction grid. Additionally, the process functions as described above in FIG. 1B.

DETAILED DESCRIPTION

FIGS. 1C, 2C, 3C and 4C—Variations of Another Embodiment

Figure 1C:
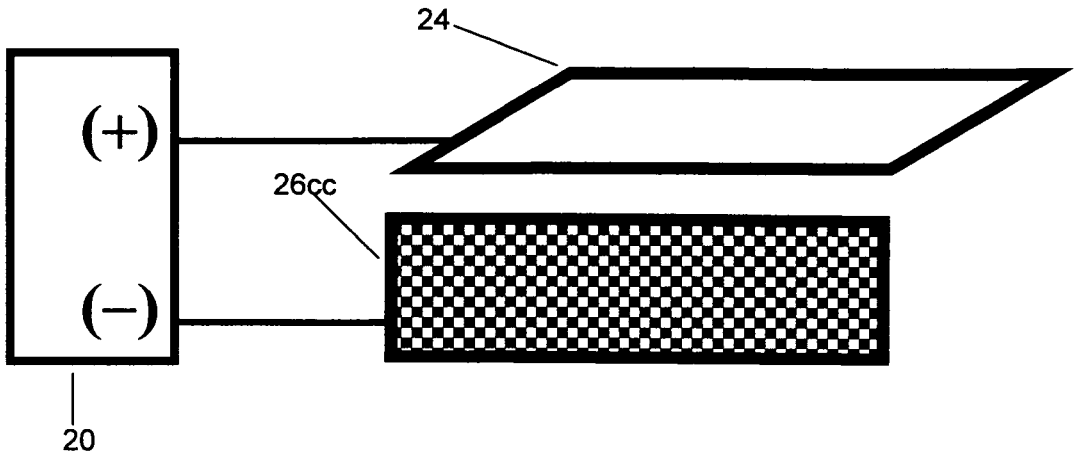
FIG. 1C shows one variation of an embodiment that produces negative ions.

FIG. 1C shows one variation of the basic components of another embodiment coupled with a schematic diagram indicating their relative position within an electronic circuit. By simply reversing the polarity upon the grid, the process is converted to the production of negative ions. The components include a "power source, part 20" with the positive terminal connected to the "positive field plate, part 24". However, in this embodiment the grid is a dual function negative electron insertion grid, "part 26*cc*". A high voltage potential difference is placed upon the conductive field plate and grid. Here the dual function grid experiences a gain of electrons and produces a strong negative electric field due to the power source and the loss of valance electrons in the atoms of the positive field plate material. To prevent electrons jumping from the grid to the positive field plate, the grid is isolated from the plate with either a sufficient gap or with a minimal nonconductive barrier or both and placed as close as possible to the field plate. Now, depending upon the implementation, as the targeted particles are guided along or through the grid apertures, every close encounter or direct contact with the negatively charged grid results in the insertion of electrons, the number being influenced by the susceptibility of the target atom or molecule.

In each of the following FIGS. 2C through 4C, the sequence of operation described above is similar, although supplementary control over the newly formed negative ions or the inserted electrons or both are added.

FIG. 2C shows another variation of the basic components of the previous embodiment coupled with a schematic diagram indicating their relative position within an electronic circuit. To this variation an ion diverter has been added, consisting of parts "30*b*" and "32*b*". By simply reversing the polarity upon the grid, the process is converted to the production of negative ions. The components include a "power source, part 20" with the positive terminal connected to the "positive field plate, part 24". However, in this embodiment the grid is a dual function negative electron insertion grid, "part 26*cc*". A high voltage potential difference is placed upon the conductive field plates. Here the dual function grid and field plate experiences a gain of electrons and produces a strong negative electric field due to the power source and the loss of valance electrons in the atoms of the positive field plate material. To prevent electrons jumping from the grid to the positive field plate, the grid is isolated from the plate with either a sufficient gap or with a minimal nonconductive barrier or both and placed as close as possible to the field plate. Now, depending upon the implementation, as the targeted particles are guided along or through the grid apertures, every close encounter or direct contact with the negatively charged grid results in the insertion of electrons, the number being influenced by the susceptibility of the target atom or molecule. Due to the production of negative ions, part 30*b* carries a positive bias voltage for diversion purposes or a higher voltage for acceleration purposes, while part 32*b* must be negatively charged.

Figure 3C:
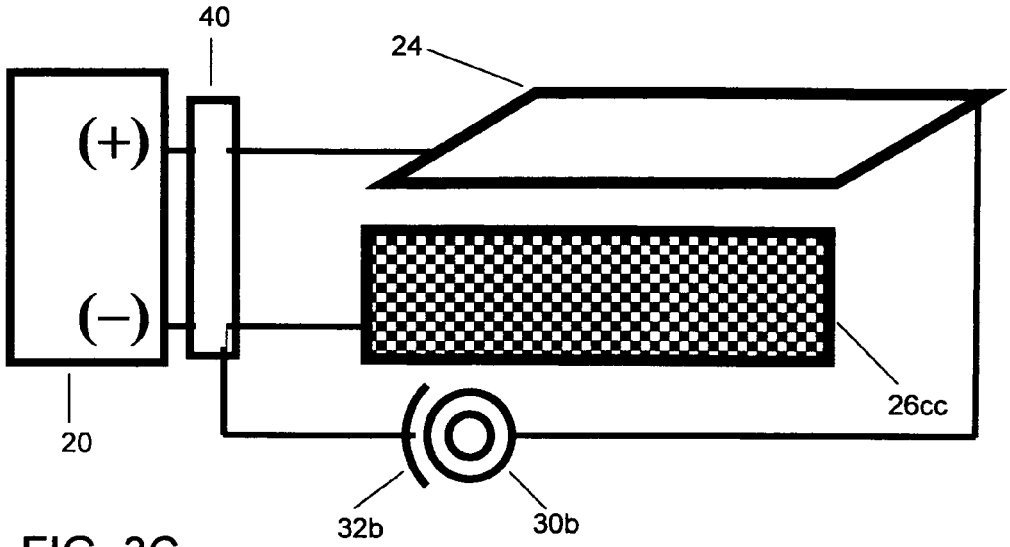
FIG. 3C shows another variation of the embodiment that produces negative ions with an attached ion diverter and control unit.

FIG. 3C shows another variation of the basic components of the previous embodiment coupled with a schematic diagram indicating their relative position within an electronic circuit. To this variation an ion diverter was previously added, consisting of parts "30*b*" and "32*b*". The new component is the field plate monitor and control unit, "part 40". By simply reversing the polarity upon the grid, the process is converted to the production of negative ions. The components include a "power source, part 20" with the positive terminal connected to the "positive field plate, part 24". However, in this embodiment the grid is a dual function negative electron insertion grid, "part 26*cc*". A high voltage potential difference is placed upon the conductive field plates. Here the dual function grid and field plate experiences a gain of electrons and produces a strong negative electric field due to the power source and the loss of valance electrons in the atoms of the positive field plate material. To prevent electrons jumping from the grid to the positive field plate, the grid is isolated from the plate with either a sufficient gap or with a minimal nonconductive barrier or both and placed as close as possible to the field plate. Now, depending upon the implementation, as the targeted particles are guided along or through the grid apertures, every close encounter or direct contact with the negatively charged grid results in the insertion of electrons, the number being influenced by the susceptibility of the target atom or molecule. Due to the production of negative ions, part 30*b* carries a positive bias voltage for diversion purposes or a higher voltage for acceleration purposes, while part 32*b* must be negatively charged. The field plate monitor and control unit, "part 40", controls the net charge upon the grid and thereby the negative ion production.

FIG. 4C shows another variation of the basic components of the previous embodiment coupled with a schematic diagram indicating their relative position within an electronic circuit. To this variation an ion diverter was previously added, consisting of parts "30*b*" and "32*b*". The new component is the multipart grid group, "part 26*cg*". By simply reversing the polarity upon the grid group, the process is converted to the production of negative ions. The components include a "power source, part 20" with the positive terminal connected to the "positive field plate, part 24". However, in this embodiment the grid is a dual function negative electron insertion grid, "part 26*cg*". A high voltage potential difference is placed upon the conductive field plates. Here the dual function grid and field plate experiences a gain of electrons and produces a strong negative electric field due to the power source and the loss of valance electrons in the atoms of the positive field plate material. To prevent electrons jumping from the grid to the positive field plate, the grid is isolated from the plate with either a sufficient gap or with a minimal nonconductive barrier or both and placed as close as possible to the field plate. Now, depending upon the implementation, as the targeted particles are guided along or through the grid apertures, every close encounter or direct contact with the negatively charged grid results in the insertion of electrons, the number being influenced by the susceptibility of the target atom or molecule. Due to the production of negative ions, part 30*b* carries a positive bias voltage for diversion purposes or a higher voltage for acceleration purposes, while part 32*b* must be negatively charged. Multipart grid groups can have two or more grid, as many as are necessary for a particular embodiment or utilization.

ALTERNATIVE EMBODIMENTS

Although the description above shows many alternatives, it should not be interpreted as to limit the scope of the embodiments but as a representation of only a number of embodiments.

ADVANTAGES

Simplicity, efficiency, adaptability, versatility, low energy consumption, and high productivity are just some of the terms that describe the advantages of the process of the present application.

CONCLUSION, RAMIFICATIONS AND SCOPE

Accordingly, the reader will see that process of the present application is superior for the extraction of electrons from atoms and molecules, the insertion of electrons into atoms and molecules, the production of positive and negative ions and the composition and decomposition of molecules,

The invention claimed is:

1. A process for the selective extraction of electrons from atoms or molecules or both or the selective insertion of electrons into atoms or molecules or both and the partial or complete decomposition of molecules and the composition of molecules, comprising:

a. providing a means to control a field through adjustment of the net average charge per atom within a substance, b. providing a means for the extraction of electrons by the application of a controlled field over a substance, c. providing a means for the production of a field through any of or combination selected from the group consisting of electric, magnetic or electromagnetic sources, d. providing a means for the positive ionization of atoms or molecules permitted to enter the field or apertures of the substance, e. providing a means to produce a continuous supply of positive ions without the production of unwanted negative ions, f. providing a means to control the extraction of one or more electrons in order of their ionization potential from an atom or molecule for the production of +1, +2, +3 or greater positive ions, g. providing a means for the insertion of electrons by the application of a controlled field over a substance, h. providing a means to produce a continuous supply of negative ions without the production of unwanted positive ions, i. providing a means for the negative ionization of atoms or molecules permitted to enter the field or apertures of the substance, j. providing a means to control the insertion of one or more electrons into an atom or molecule for the production of −1 or greater negative ions, k. providing a means for the controllable simultaneous production of positive and negative ions, l. providing a means of control for one or more constituent atoms to be extracted from selected molecules, m. providing a means of control for larger molecules to be selectively decomposed into smaller molecules, n. providing a means to control the complete decomposition of selected molecules, o. providing a means to control the composition of selected molecules.

* * * * *